US005109997A

United States Patent [19]

Phillips

[11] Patent Number: 5,109,997

[45] Date of Patent: May 5, 1992

[54] EXPANDABLE STOPPER

[76] Inventor: Edwin D. Phillips, 700 Cedar Ave., Middlesex, N.J. 08846

[21] Appl. No.: 718,657

[22] Filed: Jun. 21, 1991

[51] Int. Cl.[5] ..... B65D 39/12

[52] U.S. Cl. ..... 215/360; 215/358; 215/361; 215/364

[58] Field of Search ..... 215/358, 226, 275, 276, 215/296, 356, 360, 361, 364

[56] References Cited

U.S. PATENT DOCUMENTS

| | | | |
|---|---|---|---|
| 702,702 | 6/1902 | Burns . | |
| 2,046,224 | 6/1936 | Vanderhoop | 215/360 X |
| 2,095,272 | 10/1937 | Vanderhoof | 215/360 X |
| 2,439,628 | 4/1948 | Kopecky | 215/360 |
| 2,446,661 | 8/1948 | Murdock | 215/361 X |
| 2,536,426 | 2/1951 | Oliveira . | |
| 2,718,974 | 9/1955 | Helbig | 215/360 |
| 2,954,890 | 10/1960 | Del Valle | 215/270 |
| 3,015,403 | 1/1962 | Fuller | 215/360 X |
| 3,028,985 | 4/1962 | Pope | 215/358 X |
| 3,073,470 | 1/1963 | Greene | 215/358 X |
| 3,245,569 | 4/1966 | Essich . | |
| 3,297,187 | 1/1967 | Thiesen . | |
| 3,434,615 | 3/1969 | Barletta . | |
| 3,525,365 | 8/1970 | Meulendyk et al. | 215/358 X |
| 3,937,350 | 2/1976 | Völker | 215/361 |
| 4,019,646 | 4/1977 | Imamura . | |
| 4,800,156 | 1/1989 | Yuhda . | |

FOREIGN PATENT DOCUMENTS

| | | | |
|---|---|---|---|
| 1532385 | 1/1970 | Fed. Rep. of Germany | 215/358 |
| 1089972 | 3/1955 | France | 215/358 |
| 1174522 | 3/1959 | France | 215/360 |

*Primary Examiner*—Stephen Marcus
*Assistant Examiner*—Vanessa Caretto
*Attorney, Agent, or Firm*—Shoemaker and Mattare

[57] ABSTRACT

A stopper for a bottle mouth includes a hollow body closed at its lower end and defining a cylindrical cavity, into which a plug of relatively soft material is placed. A cap having a core portion sized to fit within the cavity, and external helical threads engaged with the internal threads within the body, can be turned to advance the core against the plug, causing the plug to expand the hollow body against the mouth. The cap may have a peripheral flange provided with threads for engaging like threads on the bottle, and these threads may be driven radially together by a band clamp.

4 Claims, 3 Drawing Sheets

EXPANDABLE STOPPER

BACKGROUND OF THE INVENTION

This invention relates to the field of closures for containers, and particularly to a bottle stopper having an element which expands to prevent accidental removal of the stopper.

In a variety of stoppers marketed today for bottles, both the bottle neck and the stopper surface must be precision ground to seal properly. The grinding operations are becoming increasingly more expensive.

In handling dangerous materials using the stoppers presently known, there is no provision to prevent the accidental removal of a stopper. Great care must, therefore, be used in handling these materials, and for shipping them, elaborate and expensive packaging is required, to keep stoppers from falling out or working loose during handling and transport.

SUMMARY OF THE INVENTION

An object of this invention is to solve the above problems, by eliminating the need to grind a precision taper both of the stopper and the bottle. Another object is to provide a locking mechanism to prevent a stopper from working loose, or being accidentally removed from its installed position.

These and other objects of the invention are achieved by a stopper for a bottle mouth which includes a hollow body closed at its lower end and defining a cylindrical cavity, into which a plug of relatively soft material is placed. A cap having a core portion sized to fit within the cavity, and external helical threads engaged with the internal threads within the body, can be turned to advance the core against the plug, causing the plug to force the hollow body outward against the mouth. The cap may have a peripheral flange provided with thread for engaging like threads on the bottle, and these threads may be driven radially together by a band clamp.

BRIEF DESCRIPTION OF THE DRAWINGS

In the accompanying drawings.

DESCRIPTION OF THE PREFERRED EMBODIMENT

Figure 1:
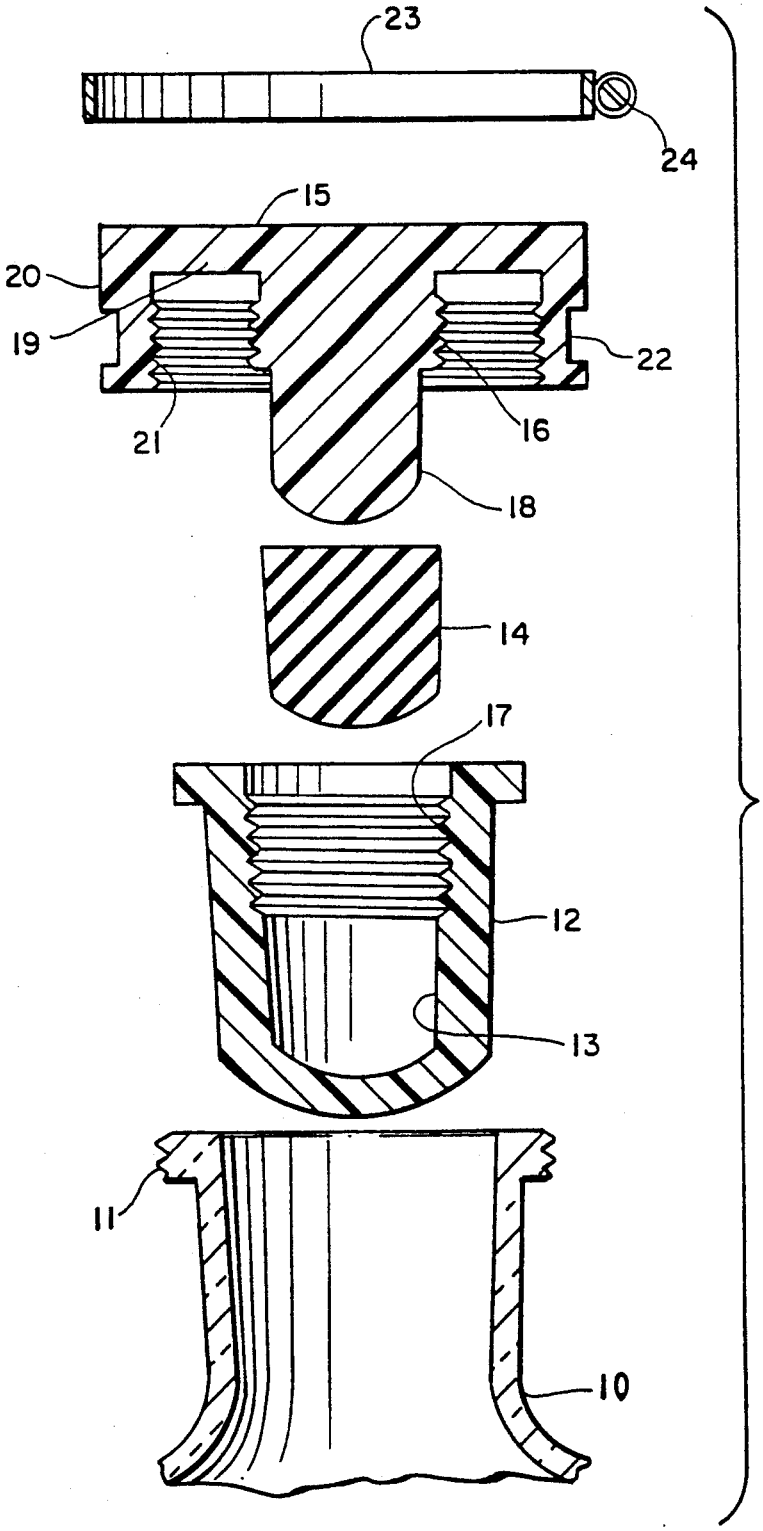
FIG. 1 is an exploded sectional view of a threaded bottle neck and stopper therefor, taken along a plane containing the longitudinal axis of the bottle.
Figure 2:
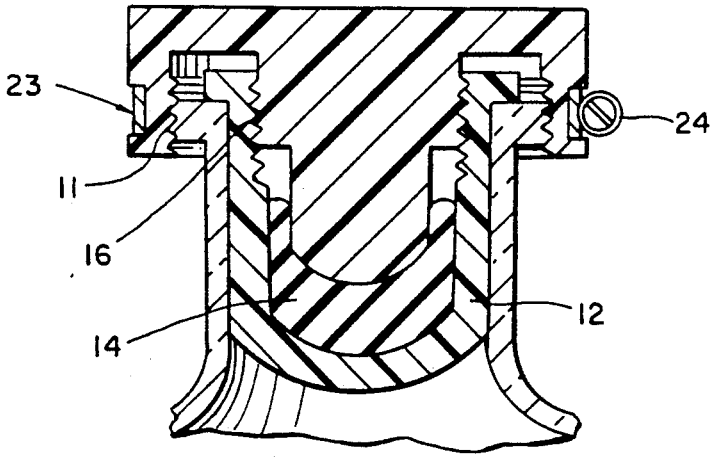
FIG. 2 shows the stopper of FIG. 1, in its assembled configuration within the bottle neck.

FIGS. 1 and 2 show a glass bottle 10 having a tapered mouth, into which the stopper of this invention is installed. The inner surface of the mouth is unground, in its as-molded condition. External screw threads 11 are formed around the periphery of the mouth, by molding or grinding.

The stopper according to this invention, includes a hollow body 12, made of a plastic such as polytetrafluoroethylene or another chemical-resistant material having similar mechanical properties. The body has a peripheral shoulder at its upper end, and defines a cylindrical cavity 13 which is closed only at its rounded, lower end. The cavity receives a plug 14 of a relatively soft material, such as rubber, shaped to fit within the lower end of the cavity, against the rounded end. By "relatively soft" we mean that the plug material has substantially less Shore hardness that both the hollow body and the cap. Since the plug does not contact the contents of the bottle, it can be selected for its mechanical properties alone, from a wide variety of materials. In case there is an elevated temperature requirement, a silicone rubber may be used.

The plug 14 is retained within the cavity 13 by a cap 15 which, again, does not contact the bottle contents, and thus can be selected from a range of materials having the proper mechanical characteristics. The cap has a central core with a tapered external thread 16 formed thereon, mating with an internal thread 17 in the hollow body. The core terminates at a rounded nose 18 that bears against the compressible plug. The cap further includes a planar top 19 extending radially outward from the core, terminating at a rim having a downturned peripheral flange 20. Threads 21, having the same pitch as the threads 16 and 17, are formed on the inside surface of the flange. The bottle's screw threads 11, mentioned above, mate with the threads 21.

The exterior of the flange has a circumferential groove 22 that receives a band clamp 23 having a tangential tightening screw 24. The recess lies at the level of the threads 21 inside the flange.

To install the stopper into the bottle, the plug 14 is first pushed into the cavity 13 of the hollow body 12. The cap 15 is then inserted into the body until the threads 16 and 17 are interengaged, and the cap assembly is pushed into the bottle mouth, until the shoulder on the hollow body seats against the end of the bottle, and the threads 11 and 21 are in contact. Since all the threads mentioned have the same pitch and hand (right-handed), clockwise rotation of the cap drives the nose against the relatively soft material of the plug. As the plug is compressed, it exerts a substantially uniform pressure on the interior surface of the body, causing the body to expand outward into tight contact with the bottle neck. Since this pressure can be very large, with sufficient tightening the body is forced to conform to the mouth shape, regardless of any irregularities in either piece, and regardless of geometrical differences between the mouth and the body 12.

After the stopper has been tightened, and a seal formed, the clamp 23 is placed into the groove 22 and tightened, driving the mating threads 11 and 21 together so tightly that the cap cannot be vibrated loose, or removed without first removing the clamp. The clamp may not be necessary in some applications.

Figure 3:
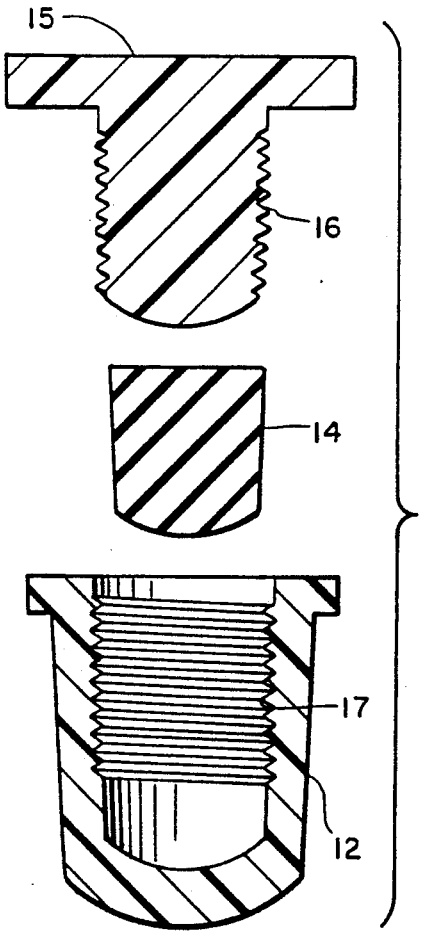
FIG. 3 is an exploded sectional view of a modified form of the invention.

The modified form of the invention shown in FIG. 3 is like that of FIGS. 1 and 2, except for the absence of the peripheral flange on the cap, and the corresponding absence of clamp 23 and threads 11 and 21. Also, the threads 16 and 17 are preferably straight for this design, rather than tapered. In many instances, this design will be satisfactory; it is of course less expensive to produce, and easier to install.

Figure 4:
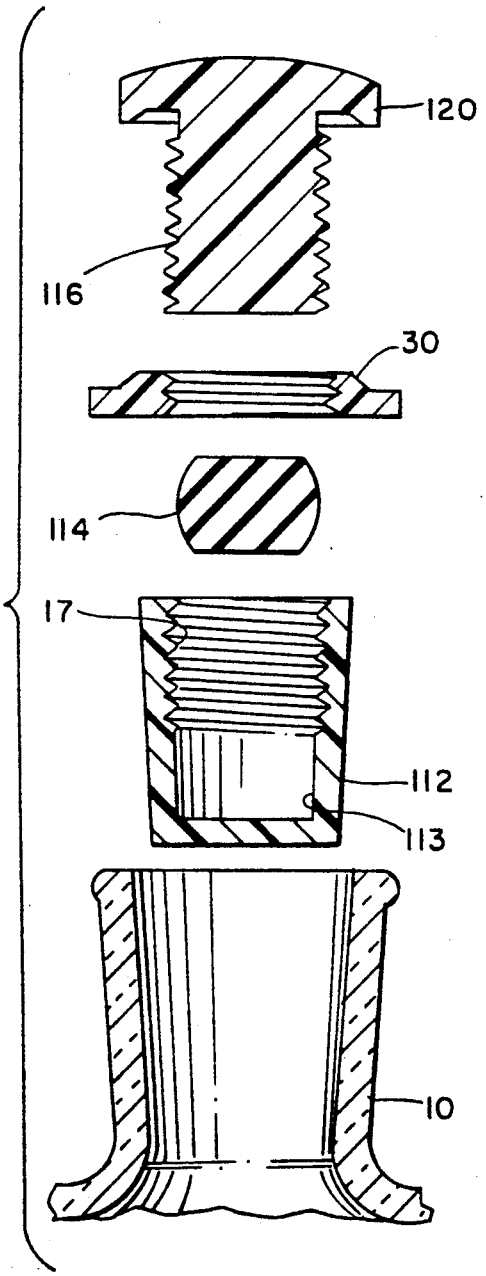
FIG. 4 is an exploded sectional view of a third embodiment of the invention.
Figure 5:
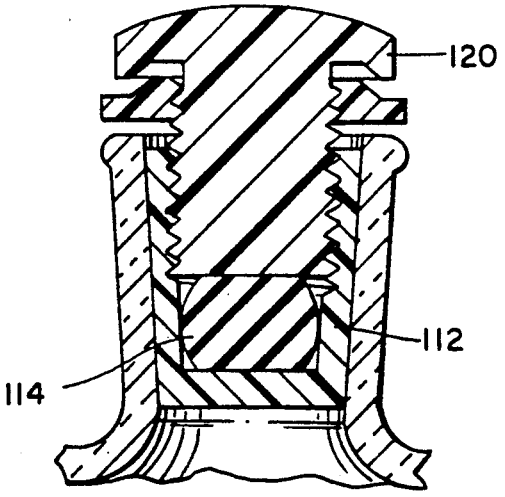
FIG. 5 is an assembled sectional view thereof.

A further modified form of the invention is shown in FIGS. 4 and 5. This variation is similar to that of FIG. 3, except that the cap is somewhat longer, so that a vertical space remains between the rim 120 of the top of the cap and the hollow body 112, when the plug 114 is fully compressed. This space leaves room for a jacking ring 30, which is threaded onto the threads of the cap against, or near to, the bottom of the cap rim. Preferably, the jacking ring has an increased thickness at its inner diameter, to provide adequate thread contact, and the top of the cap is correspondingly recessed, to receive the thicker portion of the ring. The function of the jacking ring is to forcibly withdraw the stopper from the bottle, in case the stopper becomes frozen in the neck. Turning the jacking ring clockwise brings its lower surface to bear against the top of the bottle; continued turning generates a substantial, vertical withdrawing force on the stopper, greatly in excess of the direct pulling force that could be developed manually.

The invention may be subject to changes and improvements, or adaptations for particular uses. For example, materials different from those now preferred might be used, and changes may be made in the size, shape and proportion of the elements, without altering the way in which the stopper works.

Inasmuch as the invention is subject to modifications and variations, it is intended that the foregoing description and the accompanying drawings shall be interpreted as illustrative of only one form of the invention, whose scope is to be measured by the following claims.

I claim:

1. A stopper for a bottle mouth comprising a hollow body having an inner surface defining a generally cylindrical cavity with a closed lower end, an interior helical thread formed on said inner surface, a plug of relatively soft material, placed within the cavity against said closed lower end, a cap having a core portion sized to fit within the cavity, at least a portion of the core having external helical threads engageable with the internal threads on the interior surface of the body, and a top with a radially protruding rim, whereby the cap can be turned with respect to the hollow body, once the body has been placed in a bottle mouth, the threads thereupon causing the core to advance against and compress the plug, which in turn expands the hollow body outward against the mouth, and further comprising an internally threaded jacking ring mounted on the external helical threads of the cap between the cap's top and the bottle mouth, so that in case the stopper becomes frozen in the bottle mouth, the jacking ring can be screwed down against the mouth to withdraw the stopper.

2. A stopper for a bottle having an externally threaded mouth, comprising a hollow body having a closed lower end and an inner surface defining a generally cylindrical cavity, an interior helical thread formed on said interior surface, of like pitch and hand as the threads on the bottle, a plug of relatively soft material, placed within the cavity against its closed lower end, a cap having a core portion sized to fit within the cavity, at least a portion of the core having external helical threads engageable with the internal threads on the interior surface of the body, and a top having a peripheral flange whereby the cap can be turned with respect to the hollow body, once the body has been placed in a bottle mouth, the threads thereupon causing the core to advance against and compress the plug, which in turn expands the hollow body outward against the mouth, said peripheral flange having an internal thread mating with those on said bottle.

3. The invention of claim 2, further comprising a band clamp for binding the threads of the peripheral flange against those on the bottle, to prevent accidental removal or loosening of the stopper.

4. The invention of claim 3, wherein the peripheral flange has an external circumferential groove for receiving said band clamp.

* * * * *